US011452421B1

(12) United States Patent
Ma

(10) Patent No.: US 11,452,421 B1
(45) Date of Patent: Sep. 27, 2022

(54) TELESCOPIC TUBE HOUSING A CONDUCTIVE ASSEMBLY

(71) Applicant: Shenzhen Shermon Technology Co., Limited, Shenzhen (CN)

(72) Inventor: Chaoliang Ma, Shenzhen (CN)

(73) Assignee: SHENZHEN SHERMON TECHNOLOGY CO., LIMITED, Shenzhen (CN)

( * ) Notice: Subject to any disclaimer, the term of this patent is extended or adjusted under 35 U.S.C. 154(b) by 0 days.

(21) Appl. No.: 17/242,271

(22) Filed: Apr. 27, 2021

(30) Foreign Application Priority Data

Mar. 22, 2021 (CN) ..... 202120582342.4

(51) Int. Cl.
*A47L 9/24* (2006.01)
*H01R 13/04* (2006.01)

(52) U.S. Cl.
CPC ..... *A47L 9/246* (2013.01); *A47L 9/244* (2013.01); *H01R 13/04* (2013.01)

(58) Field of Classification Search
CPC . H01R 13/04; A47L 9/246; A47L 9/26; Y10S 285/907
See application file for complete search history.

(56) References Cited

U.S. PATENT DOCUMENTS 7,883,116 B2 * 2/2011 Canale ..... A47L 9/246 285/907
8,205,911 B2 * 6/2012 Cordes ..... A47L 9/246 285/302

FOREIGN PATENT DOCUMENTS

KR 102249933 B1 * 5/2021 ..... A47L 9/248

* cited by examiner

*Primary Examiner* — Vanessa Girardi

(57) ABSTRACT

The present disclosure provides a telescopic conductive tube, including a conductive assembly and a telescopic assembly. The conductive assembly is mounted to an outer wall of the telescopic assembly and extends along a longitudinal direction of the telescopic assembly. The conductive assembly includes an upper housing, a lower housing, a conductive wire, an elastic conductive wire, a first electrode pin and a second electrode pin. The elastic conductive wire is accommodated within the telescopic assembly. The lower housing has an end fixed to the telescopic assembly. The conductive wire has an end electrically connected with the first electrode pin and an other end electrically connected with the elastic conductive wire. The elastic conductive wire has an end disposed away from the conductive wire and electrically connected with the second electrode pin. The conductive wire is sandwiched and fixed between the upper housing and the lower housing.

10 Claims, 5 Drawing Sheets

TELESCOPIC TUBE HOUSING A CONDUCTIVE ASSEMBLY

CROSS-REFERENCE TO RELATED APPLICATIONS

This application claims priority to Chinese Patent Application No. 202120582342.4, filed Mar. 22, 2021, which is hereby incorporated by reference herein as if set forth in its entirety.

TECHNICAL FIELD

The disclosure relates to accessories for vacuum cleaners, and in particular to a telescopic conductive tube.

BACKGROUND

As is well known, a hand-held vacuum cleaner generally includes a main body, a suction head, and a suction tube connecting the suction head with the main body. The suction tube is provided with a conductive assembly therein which directs electric power to the suction head with control of the main body so that the suction head starts to operate. However, the current suction tube has a fixed length larger than lengths and/or widths of the main body and the section head, which renders the vacuum cleaner inconvenient to be carried, unpopular among the consumers, and inconvenient to be packaged for sale. In order to overcome the above-mentioned defects, in some of the vacuum cleaners, the suction tube has been improved to be telescopic. However, the telescopic suction tube in the existing technology has several defects. For example, the conductive assembly has considerably complicated designs and structures since the conductive assembly should be extend or furl with lengthening or shortening of the suction tube, and maintenance of the conductive assembly is inconvenient in case of use accident. Chinese Patent Application No. 201610063853.9 discloses a telescopic conductive tube and a hand-held vacuum cleaner. In the telescopic conductive tube, a conductive joint has two sides both provided with elastic pieces and is electrically connected with contact strips through the elastic pieces. The elastic pieces are relatively thin and easy to lose elasticity and thus to be further bent or broken after a period of use, thereby affecting the electrical connection with the contact strips and resulting a relative short service life of the telescopic conductive tube. Therefore, it is necessary to maintain the electrical connection of the conductive assembly during lengthening or shortening of the suction tube, so as to increase the service life of the telescopic conductive tube.

SUMMARY

In order to solve the above-mentioned problem, the present disclosure provides a telescopic conductive tube.

The present disclosure is realized by the following technical solutions.

The present disclosure provides a telescopic conductive tube, including a conductive assembly and a telescopic assembly. The conductive assembly is mounted to an outer wall of the telescopic assembly and extends along a longitudinal direction of the telescopic assembly. The conductive assembly includes an upper housing, a lower housing, a conductive wire, an elastic conductive wire, a first electrode pin and a second electrode pin. The elastic conductive wire is accommodated within the telescopic assembly. The lower housing has an end fixed to the telescopic assembly. The conductive wire has an end electrically connected with the first electrode pin and an other end electrically connected with the elastic conductive wire. The elastic conductive wire has an end disposed away from the conductive wire and electrically connected with the second electrode pin. The conductive wire is sandwiched and fixed between the upper housing and the lower housing.

In some embodiments, the upper housing is provided with a hold down strip, the lower housing defines a hold down slot within which the conductive wire is accommodated, the hold down strip tightly press the conductive wire into the hold down slot when the upper housing is connected with the lower housing.

In some embodiments, the lower housing is provided with a fastening head thereon, the telescopic assembly includes a first mounting head provided with a first electrode connector thereon, the fastening head is fixed to the first mounting head, the first electrode pin runs through the fastening head to be inserted into the first electrode connector and thus to be electrically connected with the first electrode connector.

In some embodiments, the telescopic assembly further includes a first tube which has an end fixed to the first mounting head, the lower housing is adhered to an outer wall of the first tube.

In some embodiments, the first tube defines a limiting slot at a side wall thereof, the lower housing is provided with a limiting strip at a bottom thereof, the limiting strip is received within the limiting slot when the lower housing is adhered to the first tube.

In some embodiments, the telescopic assembly further includes a second mounting head, a control component and a second tube, the second tube has an end fixed to the control component, an other end fixed to the second mounting head, an end of the first tube disposed away from the first mounting head is inserted into the control component and extends partly into the second tube.

In some embodiments, the control component defines a first passage and a second passage, the first tube passes through the first passage into the second tube, the conductive assembly passes through the control component via the second passage.

In some embodiments, the control component is provided with a button thereon, the upper housing defines at least one locking groove thereon, the button is configured to control an engagement between the control component and the at least one locking groove.

In some embodiments, the telescopic assembly further includes a protective tube sleeved on peripheries of the control component and the second tube, the protective tube defines a through hole through which the button passes to an outside of the protective tube.

In some embodiments, the second mounting head is provided with a second electrode connector thereon, the second electrode pin is fixedly mounted to the second electrode connector and electrically connected with the second electrode connector.

The invention has advantages as follows.

In the telescopic conductive tube of the present disclosure, the elastic conductive wire is adapted to the lengthening or shortening of the telescopic assembly, i.e., is stretched or compressed when the telescopic assembly is lengthened or shortened, during which the conductive assembly keeps being electrically connected, so as to ensure stability of the electrical connection of the telescopic conductive tube when lengthened or shortened. The conductive assembly employs a simple wire to adapt the lengthening or shortening of the telescopic conductive tube, so that production cost of the telescopic conductive tube is reduced, assembly of the telescopic conductive tube is more convenient, service life of the telescopic conductive tube is prolonged as the wire has relative long service life.

DETAILED DESCRIPTION

The present disclosure will be further described below with reference to the accompanying drawings for more clearly and fully discussing the technical solutions of the present disclosure.

Figure 1:
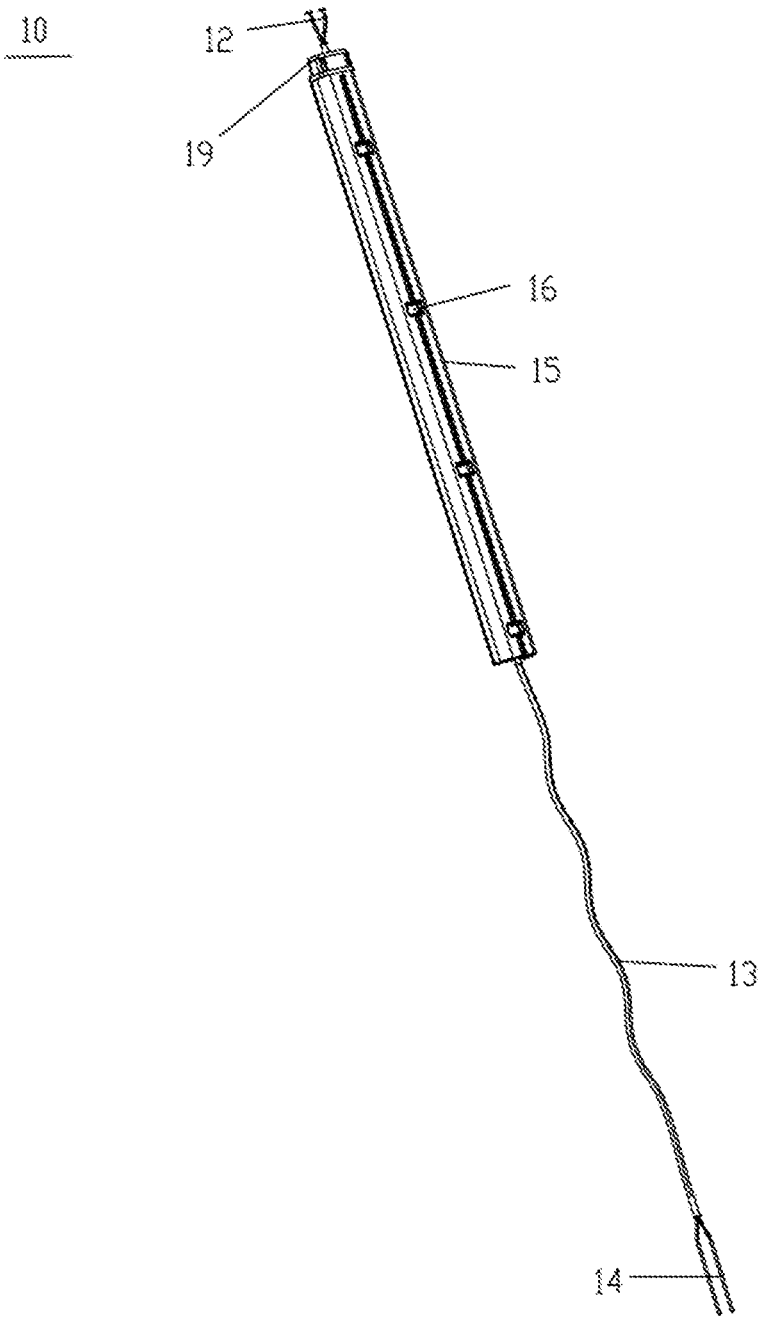
FIG. 1 is a perspective view of a conductive assembly according to the present disclosure.
Figure 2:
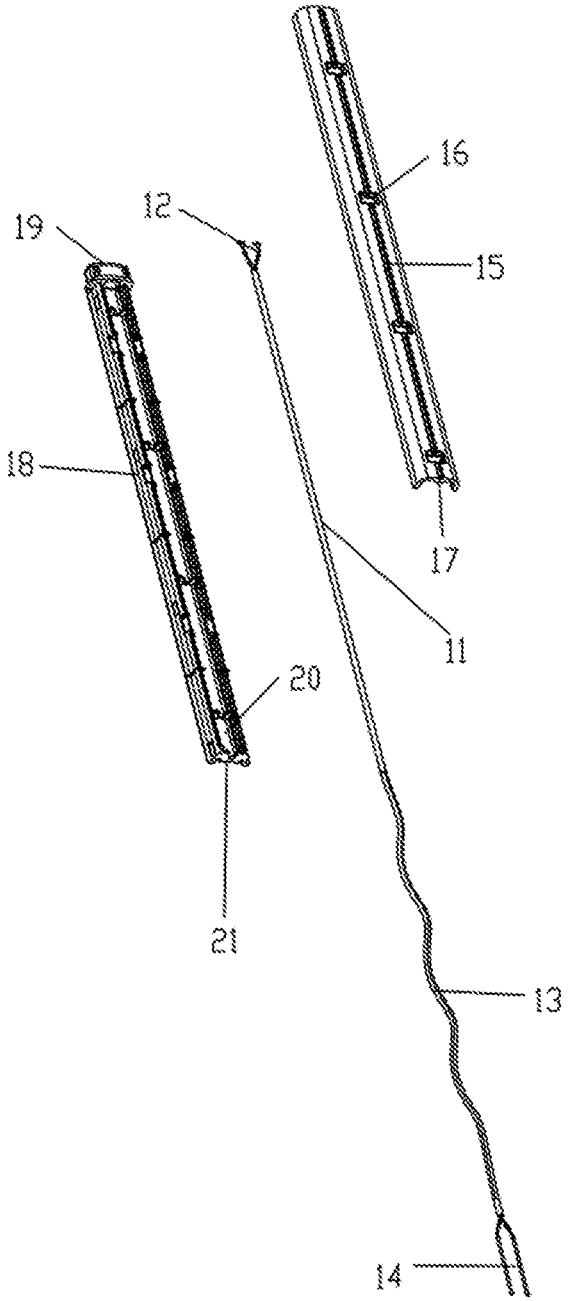
FIG. 2 is an exploded view of the conductive assembly according to the present disclosure.
Figure 3:
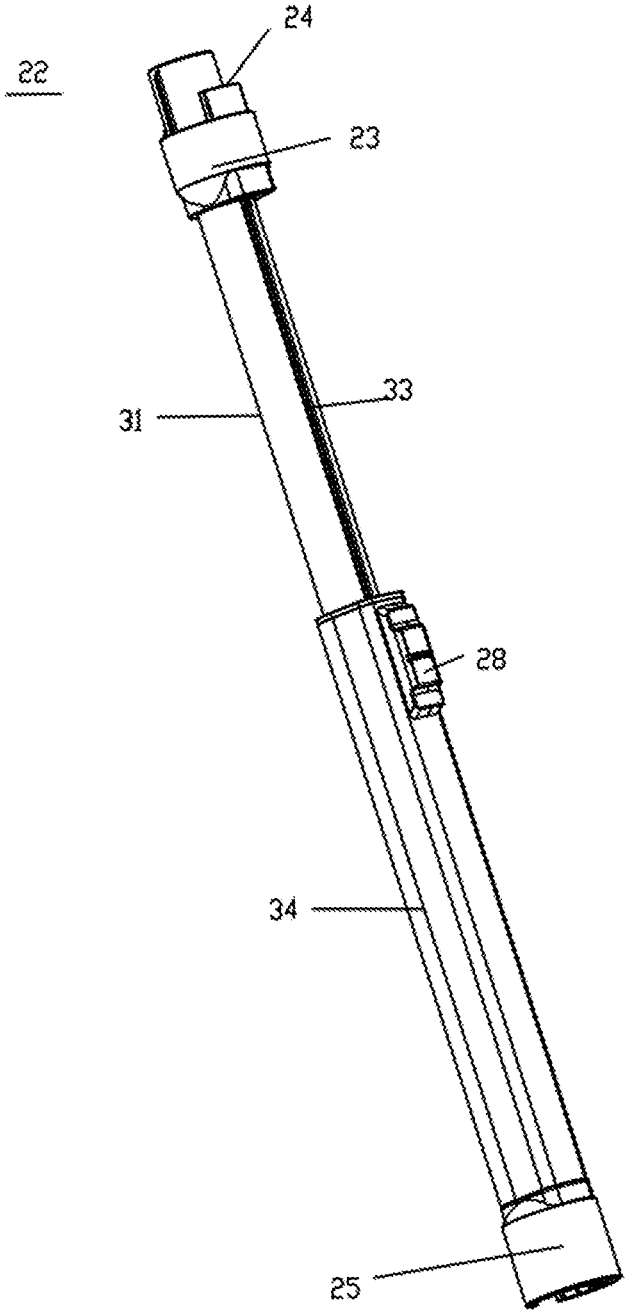
FIG. 3 is a perspective view of a telescopic assembly according to the present disclosure.
Figure 4:
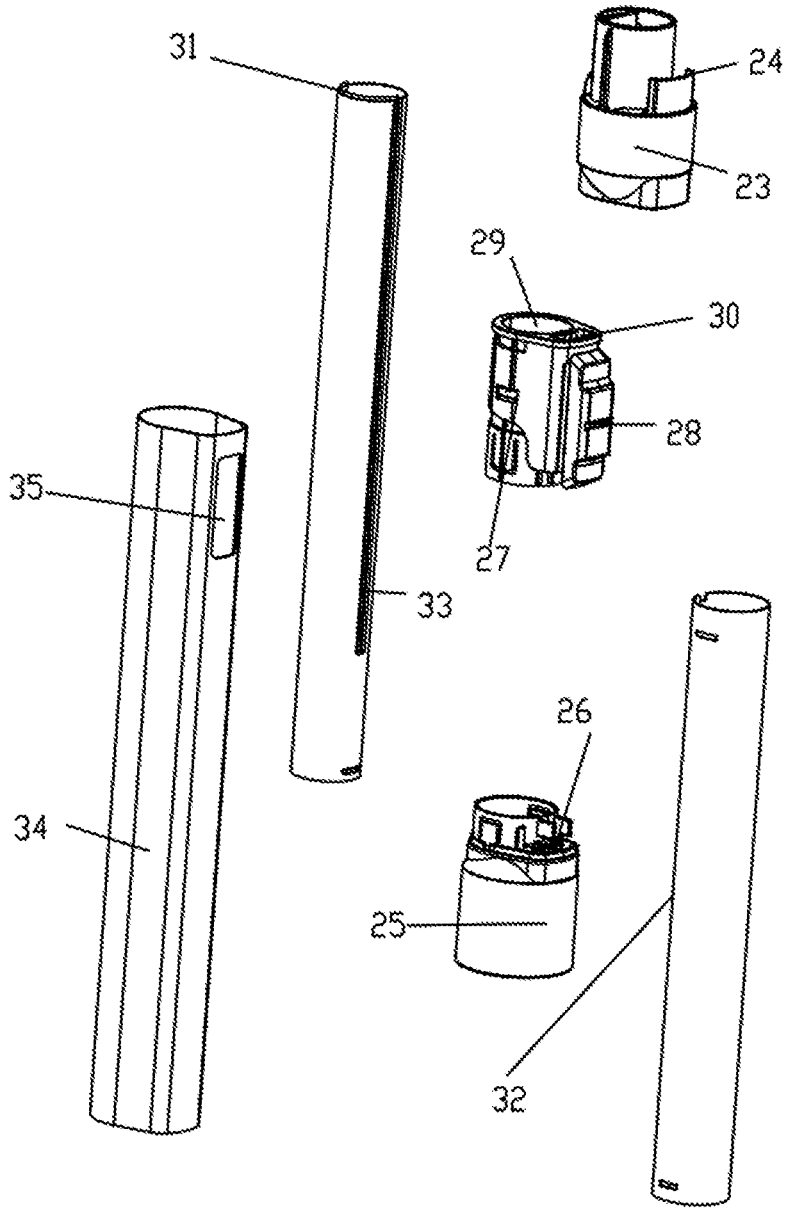
FIG. 4 is an exploded view of the telescopic assembly according to the present disclosure.
Figure 5:
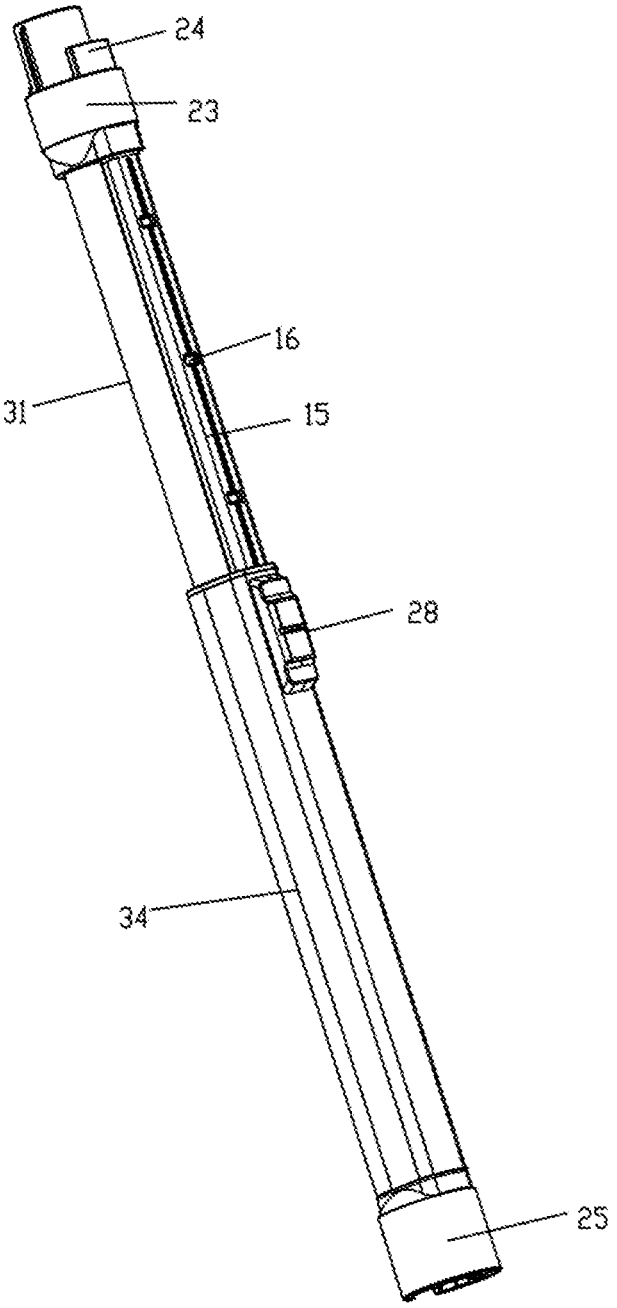
FIG. 5 is a schematically structural view of a telescopic conductive tube according to the present disclosure.

As shown in FIGS. 1 to 5, the present disclosure provides a telescopic conductive tube, including a conductive assembly 10 and a telescopic assembly 22. The conductive assembly 10 is mounted to an outer wall of the telescopic assembly 22 and extends along a longitudinal direction of the telescopic assembly 22. The conductive assembly 10 includes an upper housing 15, a lower housing 18, a conductive wire 11, an elastic conductive wire 13, a first electrode pin 12 and a second electrode pin 14. The elastic conductive wire 13 is accommodated within the telescopic assembly 22. The lower housing 28 has an end fixed to the telescopic assembly 22. The conductive wire 11 has an end electrically connected with the first electrode pin 12 and an other end electrically connected with the elastic conductive wire 13. The elastic conductive wire 13 has an end disposed away from the conductive wire 11 and electrically connected with the second electrode pin 14. The conductive wire 11 is sandwiched and fixed between the upper housing 15 and the lower housing 18. The upper housing 15 is provided with a hold down strip 17. The lower housing 18 defines a hold down slot 20 within which the conductive wire 11 is accommodated. When the upper housing 15 is connected with the lower housing 18, the hold down strip 17 tightly press the conductive wire 11 into the hold down slot 20.

In this embodiment, the elastic conductive wire 13 is like a wire used in a telephone set to connect a handset to a base unit, which is wound into a spring shape, so as to have certain elasticity to be stretched or compressed.

The conductive wire 11 is sandwiched and fixed between the upper housing 15 and the lower housing 18, so as to be prevent from moving freely. When the conductive assembly 10 is lengthened or shortened with the telescopic assembly 22, the elastic conductive wire 13 is stretched or compressed. The conductive wire 11 may be received within the telescopic assembly 22 with the upper housing 15 and the lower housing 18 received with the telescopic assembly 22.

The lower housing 18 is provided with a fastening head 19 thereon. The telescopic assembly 22 includes a first mounting head 23 provided with a first electrode connector 24 thereon. The fastening head 19 is fixed to the first mounting head 23. The first electrode pin 12 runs through the fastening head 19 to be inserted into the first electrode connector 24 and thus to be electrically connected with the first electrode connector 24.

In this embodiment, the first mounting head 23 is provided with a button configured to connect with a main body of a vacuum cleaner. The telescopic conductive tube may be removed from the main body by pushing the button. The first electrode pin 12 is fixed in the first electrode connector 24 and electrically connected with the first electrode connector 24, such that connection of the first electrode connector 24 to the main body results in electrical connection of the conductive assembly 20 to the main body.

The telescopic assembly 22 may further include a first tube 31 which has an end fixed to the first mounting head 23. The lower housing 18 is adhered to an outer wall of the first tube 31. The first tube 31 may be made from aluminum or aluminum alloy. The first tube 31 defines a limiting slot 33 at a side wall thereof. The lower housing 18 is provided with a limiting strip 21 at a bottom thereof. When the lower housing 18 is adhered to the first tube 31, the limiting strip 21 is received within the limiting slot 33.

In this embodiment, the limiting slot 33 defined by the first tube 31 is configured to limit the position of the lower housing 18 to prevent the lower housing 18 from moving leftward or rightward.

The telescopic assembly 22 may further include a second mounting head 25, a control component 27 and a second tube 32. The second tube 32 has an end fixed to the control component 27, an other end fixed to the second mounting head 25. An end of the first tube 31 disposed away from the first mounting head 23 is inserted into the control component 27 and extends partly into a protective tube 34 receiving the second tube 32. The second tube 32 may be made from aluminum or aluminum alloy. The control component 27 defines a first passage 29 and a second passage 30. The first tube 31 passes through the first passage 29 into the protective tube 34 to slide over the second tube 32. The conductive assembly 10 passes through the control component 27 via the second passage 30.

In this embodiment, a diameter of the protective tube 34 is slightly, larger than a diameter of the first tube 31, such that the first tube 31 can be inserted into the protective tube 34. When the telescopic assembly 22 is shortened, the first tube 31 is retracted into the protective tube 34 via the first passage 29.

The control component 27 is provided with a button 28 thereon. The upper housing 15 defines at least one locking groove 16 thereon. The button 28 is configured to control an engagement between the control component 27 and the locking groove 16.

In this embodiment, the lengthening and shortening of the telescopic conductive tube is control via the button 28.

The telescopic assembly 22 further includes a protective tube 34 sleeved on peripheries of the control component 27 and the second tube 32. The protective tube 34 defines a through hole 35 through which the button 28 passes to an outside of the protective tube 34.

In this embodiment, a gap is defined between the protective tube 34 and the second tube 32, and the elastic conductive wire 13 is accommodated within the gap. When the telescopic assembly 22 is shortened, the upper housing 15 and the lower housing 18 enter the gap between the protective tube 34 and the second tube 32 through the second passage 30. The protective tube 34 has a good protection function.

The second mounting head 25 is provided with a second electrode connector 26 thereon. The second electrode pin 14 is fixedly mounted to the second electrode connector 26 and electrically connected with the second electrode connector 26.

In this embodiment, the second mounting head 25 is configured to engage with a suction head of the vacuum cleaner.

It should be noted that the present disclosure may have other various embodiments. Modifications and variations made by those skilled in the art based on the embodiments according to the present disclosure without any creative work also fall within the scope of the present disclosure.

What is claimed is:

1. A telescopic conductive tube, comprising a conductive assembly and a telescopic assembly, wherein the conductive assembly is mounted to an outer wall of the telescopic assembly and extends along a longitudinal direction of the telescopic assembly, the conductive assembly comprises an upper housing, a lower housing, a conductive wire, an elastic conductive wire, a first electrode pin and a second electrode pin, the elastic conductive wire is accommodated within the telescopic assembly, the lower housing has an end fixed to the telescopic assembly, the conductive wire has an end electrically connected with the first electrode pin and an other end electrically connected with the elastic conductive wire, the elastic conductive wire has an end disposed away from the conductive wire and electrically connected with the second electrode pin, and the conductive wire is sandwiched and fixed between the upper housing and the lower housing.

2. The telescopic conductive tube according to claim 1, wherein the upper housing is provided with a hold down strip, the lower housing defines a hold down slot within which the conductive wire is accommodated, the hold down strip tightly press the conductive wire into the hold down slot when the upper housing is connected with the lower housing.

3. The telescopic conductive tube according to claim 1, wherein the lower housing is provided with a fastening head thereon, the telescopic assembly comprises a first mounting head provided with a first electrode connector thereon, the fastening head is fixed to the first mounting head, the first electrode pin runs through the fastening head to be inserted into the first electrode connector and thus to be electrically connected with the first electrode connector.

4. The telescopic conductive tube according to claim 3, wherein the telescopic assembly further comprises a first tube which has an end fixed to the first mounting head, the lower housing is adhered to an outer wall of the first tube.

5. The telescopic conductive tube according to claim 4, wherein the first tube defines a limiting slot at a side wall thereof, the lower housing is provided with a limiting strip at a bottom thereof, the limiting strip is received within the limiting slot when the lower housing is adhered to the first tube.

6. The telescopic conductive tube according to claim 5, wherein the telescopic assembly further comprises a second mounting head, a control component and a second tube, the second tube has an end fixed to the control component, an other end fixed to the second mounting head, an end of the first tube disposed away from the first mounting head is inserted into the control component and slides over the second tube.

7. The telescopic conductive tube according to claim 6, wherein the telescopic assembly further comprises a protective tube sleeved on peripheries of the control component and the second tube, the control component defines a first passage and a second passage, the first tube passes through the first passage into the protective tube, the conductive assembly passes through the control component via the second passage.

8. The telescopic conductive tube according to claim 7, wherein the control component is provided with a button thereon, the upper housing defines at least one locking groove thereon, the button is configured to control an engagement between the control component and the at least one locking groove.

9. The telescopic conductive tube according to claim 8, wherein the protective tube defines a through hole through which the button passes to an outside of the protective tube.

10. The telescopic conductive tube according to claim 6, wherein the second mounting head is provided with a second electrode connector thereon, the second electrode pin is fixedly mounted to the second electrode connector and electrically connected with the second electrode connector.

* * * * *